US007740920B2

(12) United States Patent
Wickramanayake et al.

(10) Patent No.: US 7,740,920 B2
(45) **Date of Patent: *Jun. 22, 2010**

(54) CHEMICALLY-BONDED POROUS COATINGS THAT ENHANCE HUMID FASTNESS AND FADE FASTNESS PERFORMANCE OF INK JET IMAGES

(75) Inventors: Palitha Wickramanayake, Corvallis, OR (US); James P. Shields, Philomath, OR (US)

(73) Assignee: Hewlett-Packard Development, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/249,894

(22) Filed: Oct. 10, 2008

(65) Prior Publication Data

US 2009/0035490 A1 Feb. 5, 2009

Related U.S. Application Data

(62) Division of application No. 10/854,318, filed on May 25, 2004, now Pat. No. 7,449,217, which is a division of application No. 10/096,981, filed on Mar. 12, 2002, now abandoned.

(51) Int. Cl.
*B41M 5/40* (2006.01)

(52) U.S. Cl. ..... 428/32.36; 428/304.4; 428/331; 428/446; 428/447

(58) Field of Classification Search ..... 428/32.36, 428/304.4, 331, 446, 447
See application file for complete search history.

(56) References Cited

U.S. PATENT DOCUMENTS

| | | | | |
|---|---|---|---|---|
| 5,310,591 | A | 5/1994 | Dodge et al. | |
| 5,372,884 | A | 12/1994 | Abe et al. | |
| 5,518,809 | A | 5/1996 | Henry et al. | |
| 5,612,281 | A | 3/1997 | Kobayashi et al. | |
| 5,873,934 | A | 2/1999 | Kunii et al. | |
| 5,965,252 | A | 10/1999 | Santo et al. | |
| 5,993,960 | A | 11/1999 | Nakayama et al. | |
| 6,096,469 | A | 8/2000 | Anderson et al. | |
| 6,228,475 | B1 | 5/2001 | Chu et al. | |
| 6,238,784 | B1 | 5/2001 | Mochizuki et al. | |
| 6,277,476 | B1 | 8/2001 | Shaw-Klein et al. | |
| 6,297,009 | B1 | 10/2001 | Demorest et al. | |
| 6,432,550 | B1 | 8/2002 | Ohbayashi et al. | |
| 6,492,005 | B1 | 12/2002 | Ohbayashi et al. | |
| 6,861,115 | B2 | 3/2005 | Morris et al. | |
| 6,905,729 | B2 | 6/2005 | Wickramanayake | |
| 6,964,992 | B2 | 11/2005 | Morris et al. | |
| 7,449,217 | B2 * | 11/2008 | Wickramanayake et al. | 427/333 |
| 2002/0032269 | A1 | 3/2002 | Schobe et al. | |

FOREIGN PATENT DOCUMENTS

| | | | |
|---|---|---|---|
| EP | 0355062 | | 2/1990 |
| EP | 679700 | | 11/1995 |
| EP | 0741045 | | 11/1996 |
| EP | 0983867 | | 3/2000 |
| EP | 1052111 | | 11/2000 |
| EP | 1153760 | | 11/2001 |
| EP | 1262455 | | 12/2002 |
| JP | 59192589 | | 10/1984 |
| JP | 60224580 | | 11/1985 |
| JP | 62-178384 | * | 5/1987 |
| JP | 62178384 | | 8/1987 |
| JP | 08034160 | | 2/1996 |
| JP | 2000233572 | | 8/2000 |
| JP | 2001010209 | | 1/2001 |
| JP | 2001158165 | | 6/2001 |
| WO | WO 01/05599 | | 1/2001 |
| WO | WO 02/094573 | | 11/2002 |

OTHER PUBLICATIONS

K.K. Unger, "Porous Silica," Journal of Chromatography Library, vol. 16, pp. 91-95 (1979).
C. Horvath, ed., "High-Performance Liquid Chromatography, Advances and Perspectives," vol. 2, pp. 134-139 (1980).

* cited by examiner

*Primary Examiner*—Betelhem Shewareged

(57) ABSTRACT

Silica-based, chemically-bonded porous coatings, synthesized via the reaction of organo silanes with silica, are used as coatings for inkjet image printing. Silica is used as the base material in all cases, due to its favorable chemical properties of the surface, and the favorable pore structure. The silane-silica reaction product substantially retains the original pore structure of the pre-reacted silica. The disclosed embodiments solve the problems in the prior art in that any catalytic activity of the silica surface towards image fade is eliminated by the chemical modification of silica. This improves the image fade and humid fastness properties of the coating.

1 Claim, No Drawings

CHEMICALLY-BONDED POROUS COATINGS THAT ENHANCE HUMID FASTNESS AND FADE FASTNESS PERFORMANCE OF INK JET IMAGES

CROSS-REFERENCE TO RELATED APPLICATION

This application is a divisional of U.S. patent application Ser. No. 10/854,318, filed on May 25, 2004, now U.S. Pat. No. 7,449,217, which itself is a divisional of U.S. patent application Ser. No. 10/096,981, filed on Mar. 12, 2002, which was abandoned, which is assigned to the assignee of the present patent application and which is incorporated by reference in its entirety.

TECHNICAL FIELD

The present invention relates generally to ink jet printing, and, more particularly, to print media coatings that enhance humid fastness and fade fastness of ink jet images printed thereon.

BACKGROUND ART

Image fade, which includes light and ambient air fade, is being recognized as a significant problem to overcome in ink jet printing. Earlier concerns dealt, for example, with water fastness and smear fastness. These earlier concerns have been largely overcome, and the fading of images, especially that of color images, with time has become an important issue.

One prior art solution involves the inclusion of image fade additives to the ink. However, this complicates the ink and the results have not been very promising. Inclusion of additives often reduces the reliability of the ink.

Another prior art solution involves inclusion of the additive into the media coating, which is typically silica (silicon dioxide) or silica-based. The disadvantage is that this does not yield a uniform and a homogeneous layer of the additive on the porous media surface. As a result, colorant molecules of the printed image get exposed to different chemical environments.

Yet another prior art solution is to use swellable coatings on the media that in general show better image permanence. The major disadvantages to this approach are the poor inherent dry time and wet fastness.

Thus, there is a need for reducing image fade without adversely affecting either the ink or the print medium.

DISCLOSURE OF INVENTION

In accordance with embodiments disclosed herein, chemically-modified silica coatings for print media are prepared by the treatment of silica with an organo silane. The modified print media may then be printed in an ink jet printer in the usual fashion, employing conventional ink jet inks. The silica may be treated first, and then the treated silica coated on the print medium. Alternatively, the print medium may be coated with silica, and the coated silica then treated.

The method of enhancing humid fastness and fade fastness performance of ink jet images printed on print substrates coated with silica-based compositions for print applications comprises:

(a) providing a quantity of silica;

(b) modifying the silica by reacting it with an organo silane having the formula $SiR_4$, where (i) at least one R is selected from the group consisting of halogen and alkoxy, (ii) at least one other R is an active group, and (iii) any remaining R is a lower alkyl group; and (c) coating the substrate with the modified silica.

As mentioned above, the substrate may, in the alternative, be coated with unmodified silica first and then the silica reacted with the organo silane in situ.

In a further embodiment, a combination of the print substrate and the modified silica coating thereon is provided, with the modified silica comprising the reaction product of silica and the organo silane.

A modified silica may be prepared by the use of one or more silane reagents. Alternatively, two or more independently modified materials may be blended in desired proportions.

Both the combination of the modified silica and print media and the method of the disclosed embodiments solve the problems in the prior art in that any catalytic activity of the silica surface towards image fade is eliminated by the chemical modification of silica. This improves the image fade and humid fastness properties of the coating. In other words, a friendlier chemical environment is provided for the colorant molecules of the image. The silane modifier interacts with the dye molecules in the ink via Van der Waals forces, thereby improving the humid fastness of the image. In some cases, the unattached end of the modifier carries a functional group (an opposite charge to that of the colorant molecules in some cases) that binds to the dye (colorant) molecules, thereby giving an additional interaction with the dye molecules, resulting in further improvement of humid and water fastness of the image.

Because it is a chemical modification of the surface silanol groups of the silica, a uniformly distributed bonded layer is formed, and it does not block the micropores of the original silica; the original pore structure is largely retained. The original surface is shielded by the bonded layer. The organic function of the bonded moiety interacts with the dye molecules and prevent them from moving when exposed to moisture.

BEST MODES FOR CARRYING OUT THE INVENTION

In accordance with the various embodiments disclosed herein, silica is modified and coated onto a substrate, or silica coated onto a substrate is chemically modified, by reacting the silica with one or more organo silanes (prior to or subsequent to coating). The modification reaction of silica is based on known chemistries; these steps are disclosed in a number of references, including: (1) K. K. Unger, "Porous Silica", *Journal of Chromatography Library*, Vol. 16, pp. 91-95 (1979); and (2) *High Performance Liquid Chromatography, Advances and Perspectives—Vol.* 2, Csaba Howarth, ed., pp. 134-139 (1980).

The general formula of the organo silane reagent employed in the modification reaction is $SiR_4$, wherein at least one R group must be halogen, preferably Cl, or alkoxy, preferably $C_1$ to $C_3$, and most preferably $C_1$; the halo or alkoxy R group(s) is(are) the groups that react with silanol groups on the silica surface. Of the three (or less) remaining R group(s), at least one R group must be the "active" group, described in greater detail below, and any remaining R group(s) is(are) small alkyl group(s), preferably $C_1$ to $C_3$, and most preferably $C_1$. It is the active R group that imparts the required properties to the modified silica surface.

Examples of the active R groups include, but are not limited to:

(1) linear or branched alkyl groups up to $C_{22}$, with the linear case represented by the formula —$CH_2$—$(CH_2)_n$, —$CH_3$, where n is an integer up to 20;

(2) (a) cyano, (b) amino, (c) carboxy, (d) sulfonate, (e) halogen, (f) epoxy, (g) furfuryl, (h) pyridyl, and (i) imidazoline derivative-substituted alkyl groups up to $C_8$;

(3) cycloalkyl, cycloalkenyl, and epoxycycloalkyl groups up to eight carbon atoms, and their alkyl derivatives;

(4) phenyl and phenoxy groups and their alkyl derivatives;

(5) (a) amino, (b) carboxy, (c) sulfonate, and (d) halogen substituted counterparts of (4);

(6) quaternary amine groups; and (7) mono-ethyleneimine and poly-ethyleneimine groups.

Examples of (1) include ethyl, propyl, and butyl. Examples of (2) include (a) cyanoethyl, cyanopropyl, and cyanobutyl; (b) aminoethyl, aminopropyl, aminobutyl, and combinations such as aminoethylaminopropyl and aminoethylaminobutyl; (f) 5,6-epoxyhexyl; (g) furfurylmethyl; (h) ethylpyridine; and (i) 4,5-dihydroimidazole 3-propyl. Examples of (3) include cyclohexanyl, cylohexenyl, cyclohexenylethyl, cyclopentadienyl, and 3,4-epoxycyclohexylethyl. Examples of (4) include 3-phenoxypropyl and phenoxyphenyl. Examples of (5) include (a) N-phenylaminopropyl and m-aminophenoxypropyl, (b) carboxyphenyl, (c) phenylsulfonate-ethyl, and (d) chlorophenyl. Examples of (6) include N-propyl N,N,N-trimethylammonium-chloride and (2) N-propyl N,N,N-tributylammonium-chloride.

Silica modification can be carried out according to the following general description. First, the silica is dried in a vacuum at an elevated temperature to remove adsorbed moisture. The dried silica is then allowed to cool down to room temperature.

The solvent in which the reaction to modify the silica is carried out is dried with an appropriate drying agent. Common solvents that can be used include toluene, dichloromethane, isopropanol, and methanol.

Next, the silica is mixed in the dry solvent; for example, it may be dispersed in the solvent by sonication or high energy mixing. The amount of solvent used should be selected such that the silane reagent concentration (when added) does not generally exceed about 10% of the total solvent.

The vessel containing the silica/solvent mixture may be flushed with dry nitrogen, and then the silane reagent is introduced into the reaction vessel. The amount of reagent added depends on the surface area of the silica and the surface silanol concentration of the silica. When selecting the reaction conditions, one should consider its reactivity. For example, alkoxy silanes are less reactive than the halo silane counterparts. Thus, reaction times and temperatures can be adjusted after considering the reagent used. The determination of such conditions is well within the capability of one skilled in this art. Typically, about six hours or more of refluxing under dry nitrogen is required. If carried out at room temperature rather than at elevated temperatures, longer reactions times may be necessary. Essentially, and as is well-known, the alkoxy or halogen groups react with SiOH groups to form Si-0-C bonds.

After the reaction is completed, the product material can be filtered and washed with excess solvent, and then dried. This general procedure can be carried out to prepare the coating composition for use in accordance with the teachings herein. This reaction may also be carried out without the use of excess reagent, thus eliminating the need to remove excess reagent by washing. Methanol is a preferred solvent; small amounts of it may remain in the product, since it is miscible with water, which is generally used in the subsequent coating step.

As an example, in the preparation of modified silica, about 40 grams of silica to be modified is dried overnight in a vacuum at about 110° C. to remove the adsorbed moisture. The dried silica is then allowed to cool to room temperature. Next, about 500 ml of methanol is dried over calcium sulfate. The dried silica is then mixed in the dried methanol and the silica is dispersed in methanol by sonication. Dry nitrogen is passed in to the reaction vessel at a slow rate to eliminate ambient moisture. The silane reagent is next injected in to the reaction vessel; the reaction mixture may be stirred at ambient temperature or refluxed.

The amount of silane reagent used in the reaction is dependent on the surface area of the silica, the surface silanol concentration of the silica, and the functionality of the reagent. The amount of silane reagent (in grams) needed for complete reaction for a bifunctional silane reagent (i.e., containing two alkoxy or halogen groups) is given by, based on the example in the previous paragraph, 40 g×S $m^2$/g×M g/mol×8 micro mol/$m^2$×$10^6$/2 where 40 g of silica is modified, S=surface area of silica (in $m^2$/g), M=molecular weight of the silane reagent (in g/mol), and the surface silanol concentration of silica is 8 micro mol/$m^2$. The factor of 2 comes from the assumption that one bifunctional reagent molecule reacts with two silanol groups. The product is filtered. If excess reagent is used, it is removed by washing with dry methanol. In any event, the product is then dried.

The modified silica disclosed herein is then coated on a selected substrate. The application of the coating composition on the substrate can be conducted by using any of a number of methods known in the art, including the use of an air knife coater, a blade coater, a gate roll coater, a doctor blade, a Meyer rod, a roller, a reverse roller, a gravure coater, a brush applicator, a sprayer, or the like.

EXAMPLES

Example 1

A series of commercially available modified silicas available from Waters, Mass. USA, (where the active group is aminopropyl, cyanopropyl, or octadecyl), including the corresponding unmodified counterpart, used in high performance liquid chromatography, was hand-coated onto photographic substrates, using polyvinyl alcohol as the binder. Lines of cyan, yellow, magenta, and the red, green, blue colors formed by appropriately mixing these primary colors were at an initial width of 40 mils. After being allowed to dry, the print samples were allowed to equilibrate at a temperature of 35° C. and 80% relative humidity for four days. The line widths were measured. The Table below shows the increase in line width as a result of exposure to high temperature and humidity. This increase is a measure of humid fastness; the higher the increase, then the poorer the humid bleed performance. It is observed that the modified silica performed much better than the unmodified counterpart.

TABLE

Comparison of Humid Fastness of Unmodified and Modified Silicas.

| | Unmodified | Aminopropyl | Cyanopropyl | Octadecyl |
|---|---|---|---|---|
| Cyan | 2.8 | 0.7 | 1.1 | 1.3 |
| Yellow | 16.1 | 3.8 | 6.1 | 5.3 |

TABLE-continued

Comparison of Humid Fastness of Unmodified and Modified Silicas.

| | Unmodified | Aminopropyl | Cyanopropyl | Octadecyl |
|---|---|---|---|---|
| Magenta | 8.6 | 1.9 | 4.8 | 2.3 |
| Red | 17.4 | 3.7 | 7 | 3.5 |
| Green | 8.3 | 1.2 | 3.2 | 1.2 |
| Blue | 21.7 | 3.1 | 8.3 | 5.5 |

Example 2

Silica (Sipernat 310) marketed for ink jet applications by Degussa Huls, Waterford, N.Y., was modified with the reagent shown below:

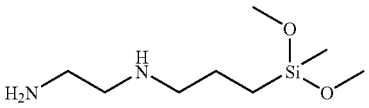

N-(2aminoethyl)-3-aminopropylmethyldimethoxysilane

The reaction was carried out in dry methanol under dry nitrogen for six hours. Excess reagent was used in the reaction; as such the unreacted reagent was extracted with dry methanol. The product was dried and elemental analysis showed that it has a carbon content of 9%, confirming that indeed the reaction was successfully completed. The product was coated onto a photographic substrate, using polyvinyl alcohol as the binder. Its image fade (light fastness and air fastness) was compared with the unmodified counterpart. For an experimental magenta dye based ink (magentas in general have the poorest image fade), the modified silica had an accelerated light fastness of 28 years; in the same test, the unmodified counterpart had an 11 year light fastness. Likewise, in an accelerated air fade test, the modified silica showed 2 to 3 times improvement relative to the unmodified.

INDUSTRIAL APPLICABILITY

The modified silica disclosed herein is expected to find use in the production of imaging media.

What is claimed is:

1. In combination, a print substrate and a modified silica coating thereon, said modified silica comprising the reaction product of silica and an organo silane having the formula $SiR_4$, where (i) one R is selected from the group consisting of halogen and alkoxy, (ii) one other R is an active group selected from the group consisting of (1) linear or branched alkyl groups up to $C_{22}$, represented by the formula —$CH_2$—$(CH_2)_n$—$CH_3$, where n is an integer up to 20; (2) (a) cyano, (b) carboxy, (c) sulfonate, (d) halogen, (e) epoxy, (f) furfuryl, (g) pyridyl, and (h) imidazoline derivative-substituted alkyl groups up to $C_8$; (3) cycloalkyl groups and their alkyl derivatives, cycloalkenyl groups and their alkyl derivatives, and epoxycycloalkyl groups up to eight carbon atoms and their alkyl derivatives; (4) phenyl groups and their alkyl derivatives, and phenoxy groups and their alkyl derivatives; and (5) (a) carboxy, (b) sulfonate, and (c) halogen-substituted counterparts of (4); and wherein the active group is other than a quaternary ammonium group, a mono-ethyleneimine group or a polyethyleneimine group, and (iii) any remaining R is a lower alkyl group having from 1 to 3 carbon atoms.

* * * * *